US011541441B2

(12) United States Patent
Hedvall et al.

(10) Patent No.: US 11,541,441 B2
(45) Date of Patent: Jan. 3, 2023

(54) TRANSPORT SYSTEM FOR A WIRE OR A SHEET AND METHOD FOR DELIVERING A WIRE OR A SHEET

(71) Applicant: Sandvik Materials Technology Deutschland GmbH, Düsseldorf (DE)

(72) Inventors: Christofer Hedvall, Bielefeld (DE); Thomas Froböse, Versmold (DE)

(73) Assignee: Sandvik Materials Technology Deutschland GmbH, Düsseldorf (DE)

( * ) Notice: Subject to any disclaimer, the term of this patent is extended or adjusted under 35 U.S.C. 154(b) by 201 days.

(21) Appl. No.: 17/040,078

(22) PCT Filed: Mar. 26, 2019

(86) PCT No.: PCT/EP2019/057607
§ 371 (c)(1),
(2) Date: Sep. 22, 2020

(87) PCT Pub. No.: WO2019/185636
PCT Pub. Date: Oct. 3, 2019

(65) Prior Publication Data

US 2021/0016336 A1 Jan. 21, 2021

(30) Foreign Application Priority Data

Mar. 27, 2018 (DE) ..... 10 2018 107 308.9

(51) Int. Cl.
*B21D 3/12* (2006.01)
*B21F 11/00* (2006.01)
(Continued)

(52) U.S. Cl.
CPC ..... *B21D 3/12* (2013.01); *B21D 3/04* (2013.01); *B21F 11/00* (2013.01); *B65H 49/32* (2013.01); *B65H 67/06* (2013.01); *B65H 2701/36* (2013.01)

(58) Field of Classification Search
CPC ..... B21C 47/02; B21C 47/16; B21C 47/26; B21C 47/34; B21C 47/28; B21D 3/04; B21D 43/28; B21F 11/00
See application file for complete search history.

(56) References Cited

U.S. PATENT DOCUMENTS 3,050,273 A 8/1962 Saunders
3,242,566 A 3/1966 White
(Continued)

FOREIGN PATENT DOCUMENTS

AT 28989 B 7/1907
AT 368725 B 11/1982
(Continued)

OTHER PUBLICATIONS

International Search Report (with partial translation) and Written Opinion dated Jul. 8, 2019, issued in corresponding International Patent application No. PCT/EP2019/057607.
(Continued)

*Primary Examiner* — Teresa M Ekiert
(74) *Attorney, Agent, or Firm* — Morgan, Lewis & Bockius LLP

(57) ABSTRACT

Transport system which makes to transport a wire or sheet of any length and with the required quality to the location of the use of the wire or the sheet. The transport system has a transport platform, a receptacle for the wire or the sheet, wherein the receptacle is configured such that the wire or the sheet may be received coiled on the receptacle, a drive, wherein the drive is configured such that the wire or the sheet may be conveyed by the drive in a transport direction, and a straightening device, wherein the straightening device is configured such that the wire or the sheet can be straightened with the straightening device, wherein the receptacle, the drive and the straightening device are arranged on the transport platform such that the wire or the sheet may be
(Continued)

drawn automatically from the receptacle and fed to the straightening device by the drive.

21 Claims, 5 Drawing Sheets

(51) Int. Cl.

| | |
|---|---|
| ***B21D 3/04*** | (2006.01) |
| ***B65H 49/32*** | (2006.01) |
| ***B65H 67/06*** | (2006.01) |

(56) References Cited

U.S. PATENT DOCUMENTS

| | | | | |
|---|---|---|---|---|
| 4,467,508 | A * | 8/1984 | Fjallstrom | B26D 11/00 D15/127 |
| 8,479,548 | B2 | 7/2013 | Ishibashi et al. | |
| 8,561,449 | B2 | 10/2013 | Veit et al. | |
| 2003/0098383 | A1 | 5/2003 | Luo et al. | |
| 2005/0005664 | A1* | 1/2005 | Scott | B21D 37/205 72/307 |
| 2011/0072874 | A1 | 3/2011 | Basler et al. | |
| 2014/0373587 | A1 | 12/2014 | Harding | |

FOREIGN PATENT DOCUMENTS

| | | | |
|---|---|---|---|
| CN | 101335121 | A | 12/2008 |
| CN | 201586717 | U | 9/2010 |
| CN | 103648939 | A | 3/2014 |
| CN | 107470505 | A | 12/2017 |
| DE | 3708859 | C1 | 6/1988 |
| DE | 4128194 | A1 | 3/1993 |
| DE | 102005007051 | A1 | 5/2006 |
| DE | 102009024075 | A1 | 12/2010 |
| DE | 102011004167 | A1 | 8/2012 |
| EP | 0266206 | A1 | 5/1988 |
| EP | 3121765 | A1 | 1/2017 |
| GB | 2202176 | B | 1/1991 |
| GB | 2471488 | A | 1/2011 |
| WO | 2015/131096 | A1 | 9/2015 |
| WO | 2017/147656 | A1 | 9/2017 |

OTHER PUBLICATIONS

Office Action with Search Report dated Mar. 6, 2019 in German application No. DE 10 2018 107 308.9.

* cited by examiner

TRANSPORT SYSTEM FOR A WIRE OR A SHEET AND METHOD FOR DELIVERING A WIRE OR A SHEET

TECHNICAL FIELD

The present disclosure relates to a transport system for a wire or a sheet, as well as a method for transporting a wire or a sheet.

The present disclosure also relates to a method for delivering a wire or a sheet.

BACKGROUND

A plurality of wires or sheets, but in particular cold-formed wires or sheets made of stainless steel, can be processed further after the actual production of the wire or sheet only with difficulty, without the material properties of the wire or sheet changing. Today, such wires or sheets are supplied to the customer's premises as sections of the wire or the sheet and processed further there. The wires or sheets are supplied in maximum lengths; in this way they can be transported stretched out on an HGV. Typical maximum lengths of the individual sections of the wire or the sheet supplied are therefore approximately 12 m.

According to one aspect of the present disclosure, it is necessary to create a transport system which makes it possible to transport a wire or sheet with any desired length and with the required quality to the place of use of the wire or the sheet.

SUMMARY

A transport system for a wire or a sheet is therefore proposed, with a transport platform, a receptacle for the wire or the sheet, wherein the receptacle is configured such that the wire or the sheet can be received coiled up on the receptacle, a drive, wherein the drive is configured such that, with the drive, the wire or the sheet can be conveyed in a transport direction, and a straightening device, wherein the straightening device is configured such that the wire or the sheet can be straightened with the straightening device, wherein the receptacle, the drive and the straightening device are arranged on the transport platform such that, with the drive, the wire or the sheet can be drawn off the receptacle and fed to the straightening device in an automated manner.

The idea forming the basis of this transport system is to provide a transport system for a coiled wire or a coiled sheet with substantially any desired length, limited only by the volume of the coil. However, a coiled wire or a coiled sheet typically does not conform to the customer's requirements, at least with regard to its straightness. The transport system therefore makes an automated final processing of the wire or sheet possible at the place of use of the wire or sheet, i.e. at the customer's premises. This makes it possible to allow the transport system for the wire or the sheet to be provided by the manufacturer of the wire or the sheet, wherein the latter assumes for example the responsibility for the final processing at the customer's premises, wherein the customer only takes finished sections of the wire or the sheet with the desired length and quality from the transport platform. In one embodiment, the final machining is effected in a fully automated manner.

In one embodiment of the disclosure, the transport system additionally has a cutting device, wherein the cutting device is configured and arranged such that the wire or the sheet can be severed with the cutting device, with the result that a section of the wire or the sheet can be produced with a selectable length, and wherein the receptacle, the drive, the straightening device and the cutting device are arranged on the transport platform such that, with the drive, the wire or the sheet can be drawn off the receptacle and fed to the straightening device and the cutting device in an automated manner.

A transport platform is a carrier which has sufficient stability to receive the further elements of the transport system, wherein this stability is also provided during transport, e.g. by a heavy goods vehicle, from one location to another location.

It is crucial that, in one embodiment, the transport platform itself can be handled by crane and/or conveyed or is connected to a device, for example the floor of a roller container or a transport container, which can in turn be handled by crane or conveyed. In one embodiment of the present disclosure, the transport platform can be transported for example with an industrial truck or container-handling equipment and can be received on a means of transport, such as for example a heavy goods vehicle or a railway wagon. In one embodiment, the transport platform or the device connected to it has the devices necessary for handling by crane and/or conveying. In one embodiment, the transport platform or the device connected to it has lifting eyes for securing hoisting devices and/or recesses for receiving the forks of an industrial truck.

In one embodiment of the present disclosure, the transport system additionally has four side walls and a roof. In one embodiment, the four side walls and the roof are joined to the transport platform and together form a transport container, wherein the transport platform forms the floor of the transport container. In a further embodiment, a transport container is formed by the four side walls, the roof and an additional floor, wherein the transport platform is received on the floor inside the transport container and is preferably joined to it. The side walls and the roof make it possible to transport the wire or the sheet protected against environmental conditions. Likewise, the side walls and the roof provide protection for the other devices of the transport platform.

Such a solution also makes it possible to completely take away the customers access to the coiled wire or the coiled sheet as well as the devices inside the transport container. In one scenario, the manufacturer supplies a coiled wire or a coiled sheet in a closed transport container of the transport system according to the disclosure and the customer takes the wire or the sheet, or in one embodiment sections of the wire or the sheet with the length required in each case, from the transport container in an automated manner.

In one embodiment, a closable loading opening is provided in one of the side walls or in the roof for loading the transport system with the coiled wire or sheet.

In a further embodiment of the present disclosure, a closable unloading opening is provided in one of the side walls or in the roof, with the result that the wire or the sheet or a section of the wire or the sheet can be taken out of the transport system through the unloading opening, wherein the receptacle, the drive, the straightening device and optionally the cutting device are arranged such that the wire or the sheet or a section of the wire or the sheet can be ejected through the unloading opening. It is understood that the unloading opening is arranged behind the last device on the transport platform in the conveying direction of the wire or sheet.

In one embodiment of the present disclosure, the transport system comprises a roller container to be received on a heavy goods vehicle, wherein the transport platform is the floor of the roller container or the transport platform is received on a floor of the roller container. Such roller containers are known for example as part of operational systems of the emergency services such as the fire service and Technisches Hilfswerk [technical relief agency] and are easy to transport with a corresponding heavy goods vehicle and to set down essentially with pinpoint accuracy. In one embodiment, the roller container has an eye for gripping the roller container as well as optionally at least one roller under the floor of the roller container.

In an alternative embodiment of the present disclosure, the transport system comprises a transport container, for example a 40-foot container, in particular a 40-foot ISO container, wherein the transport platform is the floor of the transport container or the transport platform is received on a floor of the transport container. It is understood that, in one embodiment of the present disclosure, another roller base frame can be provided under the floor of the transport container. The roller base frame makes it possible to transport and set down or pick up a conventional transport container as a roller container with a correspondingly equipped heavy goods vehicle. For this, in one embodiment, the roller base frame has an eye for gripping the roller container as well as optionally at least one roller under the floor of the roller container.

A coiled-up or coiled wire denotes, within the meaning of the present application, a wire that is wound up, i.e. curved substantially in the shape of a circular arc in one or more windings. A coiled-up or coiled sheet denotes, within the meaning of the present application, a sheet that is wound up, i.e. curved substantially in the shape of a circular arc in one or more windings.

In one embodiment, the receptacle for such a coiled wire or such a coiled sheet can be designed such that a drum, for example made of wood, can be received on it, wherein in turn the wire or the sheet is coiled onto the drum. Almost any desired lengths of wires or sheets can be coiled onto a drum.

If cold-formed wires or sheets made of stainless steel are considered, their length is initially limited by the length and mass of the slabs or blooms forming the basis of the manufacture (raw material for the cold-forming process, such as cold pilger rolling or cold drawing). However, lengths which can no longer be manufactured in a single piece by cold forming can also be provided in the transport system according to the present disclosure in one embodiment.

In one embodiment, therefore, several wires or sheets manufactured by cold forming are joined together to form a single long wire or sheet before being coiled onto a drum. This has the advantage that, continuously and without interruption, wire material or sheet material can be fed to the devices on the transport platform, in particular the drive, the straightening device and optionally the cutting device, without intervention by a user being necessary.

Therefore, in one embodiment of the present disclosure, the transport system has a coiled wire or a coiled sheet, wherein the wire or the sheet is received on the receptacle. In one embodiment, the wire or the sheet consists of a plurality of cold-formed sections of the wire or the sheet made of a stainless steel joined together at their end faces. In this way, for example, coiled wires and sheets with a length of up to 17,000 m can be supplied, which are then cut on-site into sections of the wire or the sheet with the required lengths. In one embodiment of the invention, the drum with the wire or sheet coiled thereon is part of the transport system.

The joining of several wires or sheets at their end faces to form one long wire or sheet, which is then coiled, can be effected in quite different ways. In one embodiment of the present disclosure, the individual wires or sheets are joined together by welding. Although welding the individual cold-formed sections of the wire or the sheet changes the properties of the wire or sheet in the area of the welded joint, the welded joint can be cut out when sections of the wire or the sheet are taken out of the transport system and can be recycled as scrap. Alternatively, the ends of two wires joined together can be crimped to each other.

In one embodiment according to the present disclosure, the transport system comprises a device for detecting welded joints, which may be arranged before the cutting device in the material-flow direction. The device for detecting welded joints is configured and arranged such that it detects a welded joint between two wire sections or sheet sections joined together. Such a detection of a welded joint can be effected for example with the aid of a camera and suitable image-evaluation software or else with the aid of an eddy current sensor. In one embodiment, the controller is connected to the device for detecting welded joints and configured such that it controls the cutting device such that it cuts the welded joint out of the wire or the sheet.

In an alternative embodiment of the present disclosure, the receptacle for the wire or the sheet comprises a reel, on which a wire or sheet coiled loosely without a core or drum can be received. Such a wire or sheet coiled without a core or drum is also called a "loose coil". Such loose coils can for example be re-loaded onto the reel again and again by a customer, when the material is used up.

In one embodiment of the present disclosure, the receptacle for the wire or the sheet comprises, in addition to the reel for loading a loose coil, an adjustment device which makes it possible to draw the wire or sheet off the reel at the height of the intake into the other devices of the transport system. In addition to such a height adjustment, the receptacle can also have a tilt device which makes it possible to tilt the winding axis of the reel. In a preferred embodiment, the winding axis is substantially horizontal for loading of the coiled wire or sheet by a user and substantially vertical for drawing the coiled wire or sheet off.

While the transport system according to the present disclosure is suitable in principle for all types of wires or sheets, in one embodiment the wire or the sheet is a wire or a sheet made of a metal, preferably made of steel, but in particular made of a stainless steel. In a further embodiment, the wire or the sheet is a work-hardened wire or a work-hardened sheet which was no longer annealed after cold-forming. In one embodiment, the wire or the sheet contains a cold-formed, i.e. work-hardened, stainless steel or consists thereof. It is understood that, in one embodiment of the invention, the wire or the sheet is part of the transport system.

The drive within the meaning of the present disclosure can be either a drive integrated into one of the other elements, in particular the receptacle, the straightening device or the cutting device, which brings about the necessary feed motion of the wire or sheet, or a separate driving tool which is provided for bringing about the feed motion.

In one embodiment of the present disclosure, the straightening device, in particular a straightening set, can be designed such that it is actively driven in order to provide the necessary feed motion for feeding to the individual devices, but also for drawing the wire or sheet off the receptacle.

In a further embodiment of the present disclosure, the drive is part of the receptacle, which then has the effect that the receptacle uncoils the wire or the sheet and feeds it to the further devices.

In one embodiment of the present disclosure, the driving tool is a roller conveyor, wherein the wire to be conveyed or the sheet to be conveyed is guided between at least two rollers, wherein the rollers are driven in an automated manner and are in frictional engagement with the wire or the sheet, with the result that a rotation of the rollers leads to an advance of the wire or sheet.

In a further embodiment of the present disclosure, the straightening device comprises a straightening set with at least two profile rollers or a skew-rolling straightening machine.

The straightening device serves to bring the coiled wire or the coiled sheet back into a shape stretched out straight with the necessary straightness.

In a further embodiment of the present disclosure, the cutting device comprises a saw or a parting-off head, which makes it possible to sever the wire or sheet. In this way, the customer can take sections of the wire or the sheet of almost any desired length from the transport system in a finished state. In a further embodiment, the cutting device comprises a stamp or a laser-cutting device for stamping or cutting out any desired shapes from the sheet.

In a further embodiment of the present disclosure, the cutting device has a cooling system for cooling a cut surface of the wire or sheet with $CO_2$. Such a cooling system is advantageous for providing high-quality cut surfaces.

It is understood that the transport system can have, beyond the necessary devices, i.e. the drive, the straightening device and optionally the cutting device, any desired further devices for machining or processing the wire or sheet.

Thus, in one embodiment of the present disclosure, the transport system has a marking device arranged on the transport platform, for example a printer, for marking a section of the wire or the sheet. In this way, the sections of the wire or the sheet taken from the transport system can be clearly marked. Possible items of information that can be applied to the section of the wire or the sheet are for example its material and length.

In a further embodiment of the present disclosure, the transport system has a bending device arranged on the transport platform for defined bending of a section of the wire or the sheet. The bending device makes it possible to bend a straightened and cut-to-length or cut-out section of the wire or the sheet into the shape needed for the further processing. Such a bending device is advantageous for example when the sections of the wire or the sheet taken out of the transport system are to be used in aircraft manufacture, where the sections of the wire or the sheet must have a curved shape with a defined radius of curvature before installation.

In a further embodiment of the present disclosure, the transport system has a degreasing device arranged on the transport platform for degreasing the wire or sheet. In this way, oil residues, which typically arise from preceding manufacturing steps for the wire or sheet, can be removed.

In a further embodiment, the transport system comprises a polishing device, which is configured and arranged such that a section of the wire or sheet can be polished with the polishing device.

In one embodiment of the disclosure, the transport system comprises a device for deburring the ends of the wire or sheet severed by the cutting device.

The transport system according to the present disclosure has the advantage for the customer purchasing the wire or sheet that from the transport system they can take straightened sections of the wire or the sheet with a length and/or shape predefined by the customer. In one embodiment, the customer need not worry about either the transport or the final manufacturing steps such as straightening and cutting.

For the manufacturer of the wire or sheet, the transport system according to one embodiment of the present disclosure has the advantage that they integrate the final manufacturing steps such as straightening and cutting into the customer's production process.

In one embodiment of the transport system, the transport system has an electronic controller effectively connected to the receptacle and/or the drive and/or the cutting device, wherein the controller is configured such that during operation of the transport system the controller receives data from the receptacle and/or the drive and/or the cutting device and/or issues control commands to the receptacle and/or the drive and/or the cutting device. It is understood that, in one embodiment, the electronic controller has a processor, in particular a computer.

In a further embodiment of the present disclosure, the controller comprises a communications interface that can be connected to a data network, wherein the communications interface is configured such that, with the communications interface, data can be transmitted from the transport system to a server and/or from a server to the transport system. It is understood that, in one embodiment, the data network is the internet.

With the transport system according to the present disclosure, the manufacturer of the wire or sheet may connect directly to their customer's production process. With the aid of the controller, data can be collected from the individual devices of the transport system, but also from the wire or sheet received therein, and fed into the manufacturer's manufacturing process and into the customer's manufacturing process via the communications interface.

In one embodiment, the controller detects what lengths of the wire or sheet of a coiled wire or sheet received on the receptacle have been taken from the transport system by the customer and the controller triggers a repeat order, via the interface, as soon as it is identifiable when the wire or sheet received on the receptacle has been used up.

With the aid of the controller and the communications interface, a tally of the amount of wire or sheet taken out of the transport system by the customer can also be calculated and invoicing can be triggered.

On the other hand, via the communications interface the customer can for example transmit to the controller the length of a section of the wire or the sheet to be provided next, with the result that the transport system prepares and ejects the desired length of a section of the wire or the sheet. Furthermore, via the controller and the communications interface, a certificate or report about the quality and grade of a section of the wire or the sheet taken out of the transport system can be transmitted directly to the customer, with the result that the latter can generate their documentation for the built-in sections of the wire or the sheet in an automated manner.

The transport system according to the present disclosure thus makes a direct interlocking possible between the manufacture of the wire or the sheet by the manufacturer and the further processing of the wire or sheet by the customer.

It is understood that, in one embodiment of the present disclosure, the communications interface is a network interface for connection to a LAN or a wireless LAN. In particular, however, the communications interface, in one embodiment, is a mobile radio interface, for example based on the LTE standard.

In addition, in one embodiment of the present disclosure, the controller has an electronic reading device for contactless reading of a data carrier.

Within the meaning of the present application, the term data carrier is to be understood broadly. Examples of such a contactlessly readable data carrier are an RFID tag or also a barcode. Such an electronic reading device, in one embodiment, makes an automated detection of the wire or sheet material received on the receptacle possible.

For this, the transport system, in one embodiment, has a drum for the coiled wire or the coiled sheet, in particular a drum with the coiled wire or the coiled sheet, wherein the drum is received on the receptacle and wherein the drum is provided with a contactlessly readable data carrier, which can be read by the reading device of the controller. After the transport system has been loaded with the drum, preferably the drum with the coiled wire or the coiled sheet, the controller automatically has the information available as to what type of wire or sheet the transport system can provide to the customer.

In a further embodiment of the present disclosure, the transport system has a coiled wire or a coiled sheet, wherein the wire or the sheet is received on the receptacle and wherein the wire or the sheet is provided with a contactlessly readable data carrier, which can be read by the reading device. In the case of such an embodiment, it is possible to provide the determination of the type of wire or sheet which is received in the transport system and which can be made available to the customer, not indirectly or not exclusively indirectly via the drum for the coiled wire or the coiled sheet, but directly through a marking of the wire or sheet itself. It is understood that the contactlessly readable data carrier can be integrated for example into the wire or the sheet. In one embodiment of the present disclosure, the contactlessly readable data carrier is attached to the outside of the wire or sheet. If the attachment of the contactlessly readable data carrier is effected in an end section of the wire or sheet, this end section can be cut off at the start, so that the data carrier does not disrupt the further processing processes.

In addition, a method for delivering a wire or sheet is proposed with the steps of coiling up the wire or sheet, receiving the wire or sheet on a receptacle arranged on a transport platform, transporting the transport platform from a first location to a second location, conveying the wire or sheet in a transport direction with a drive arranged on the transport platform, with the result that the wire or the sheet is drawn off the receptacle and fed to a straightening device in an automated manner, and straightening the wire or sheet using the straightening device arranged on the transport platform.

In one embodiment, the conveying of the wire or the sheet additionally comprises a feeding to a cutting device and the method has the step of severing the wire or sheet in the cutting device arranged on the transport platform, with the result that a section of the wire or the sheet is produced with a selected length.

Where aspects of the present disclosure with regard to the transport system are described in the preceding and in the following, these also apply to the corresponding method for delivering a wire or sheet, and vice versa. Where the method is carried out with a transport system according to this disclosure, the latter has the corresponding devices for this. In particular, embodiments of the transport system are suitable for carrying out the method.

It is to be noted that the above-named method steps need not necessarily be passed through in the order indicated. Thus, it is conceivable for the transport platform to be transported first and then for the coiled wire or the coiled sheet to be received on the receptacle. However, it is likewise possible for the coiled wire or the coiled sheet to be received on the receptacle first and then for the transport platform to be transported with the wire or sheet.

In one embodiment, the steps of straightening and severing can also be swapped, in particular when sections of the wire or the sheet are manufactured with short lengths or dimensions.

In one embodiment, the conveying, the straightening and optionally the cutting are controlled by a common controller, wherein the controller collects data which are a measure of the length of the wire or sheet drawn off the receptacle, and wherein the controller transmits the data to a server via a communications interface and a data network.

Further advantages, features and possible uses of the present disclosure will become clear with reference to the following description of embodiments and the associated figures. The preceding general description as well as the following detailed description of embodiments will be better understood when they are read in conjunction with the attached drawings. It is to be noted that the embodiments shown are not limited to the precise arrangements and means.

DESCRIPTION OF THE FIGURES

Identical elements are given identical reference numbers in the figures.

Figure 1:
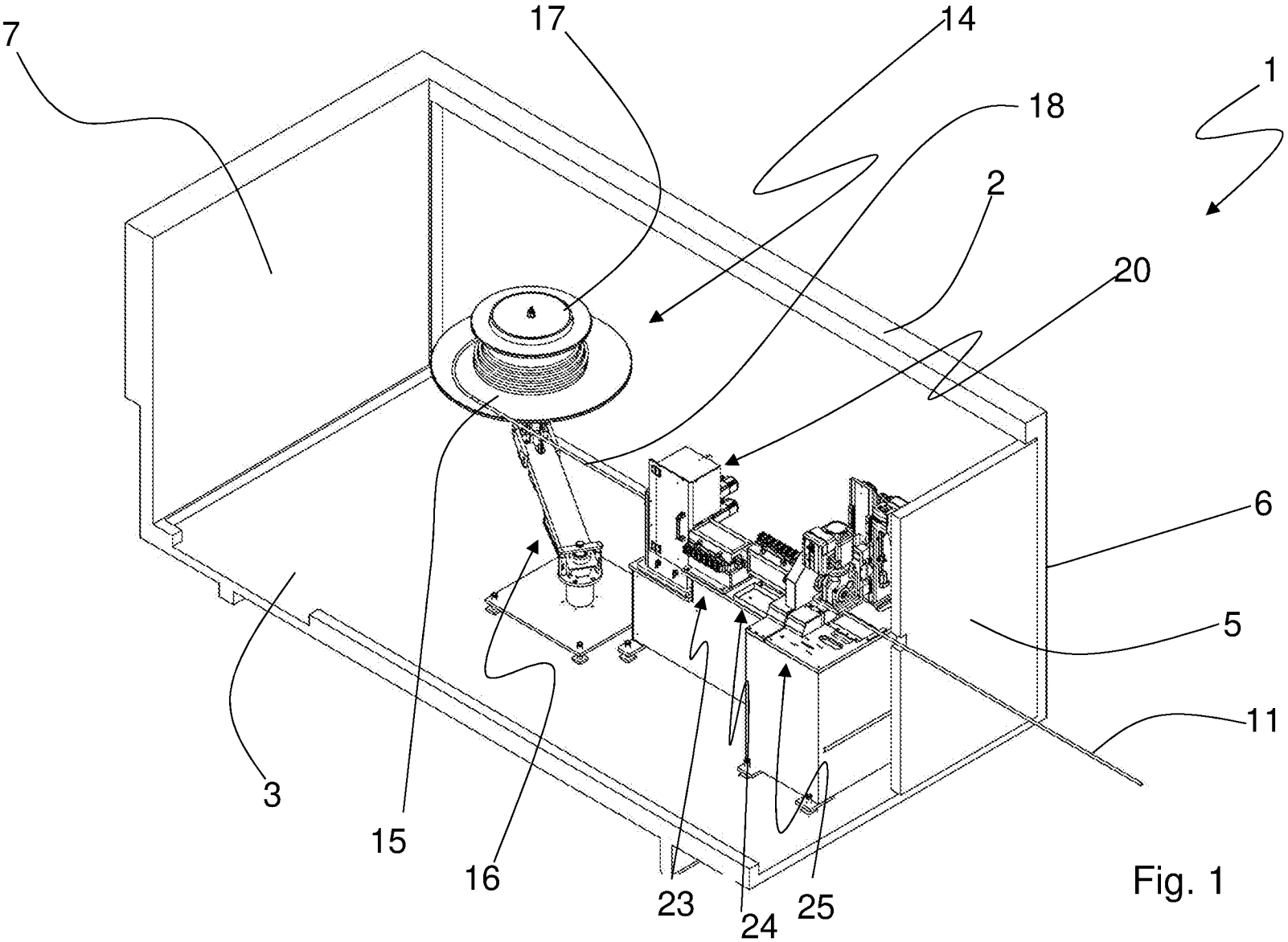
FIG. 1 is a partially broken-away perspective representation of a transport system according to a variant of the present disclosure.
Figure 2:
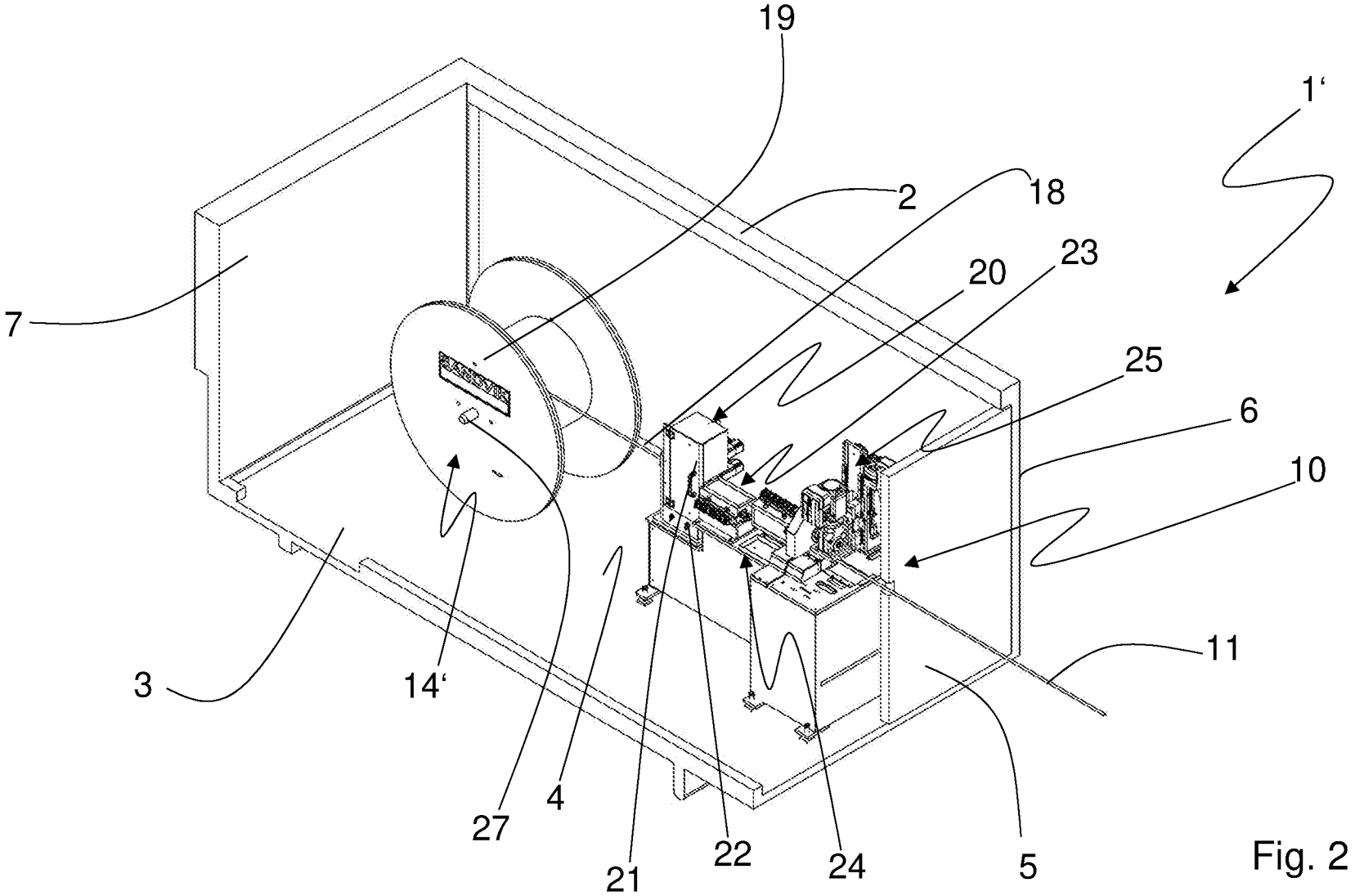
FIG. 2 is a partially broken-away perspective representation of a further variant of a transport system according to the present disclosure.
Figure 3:
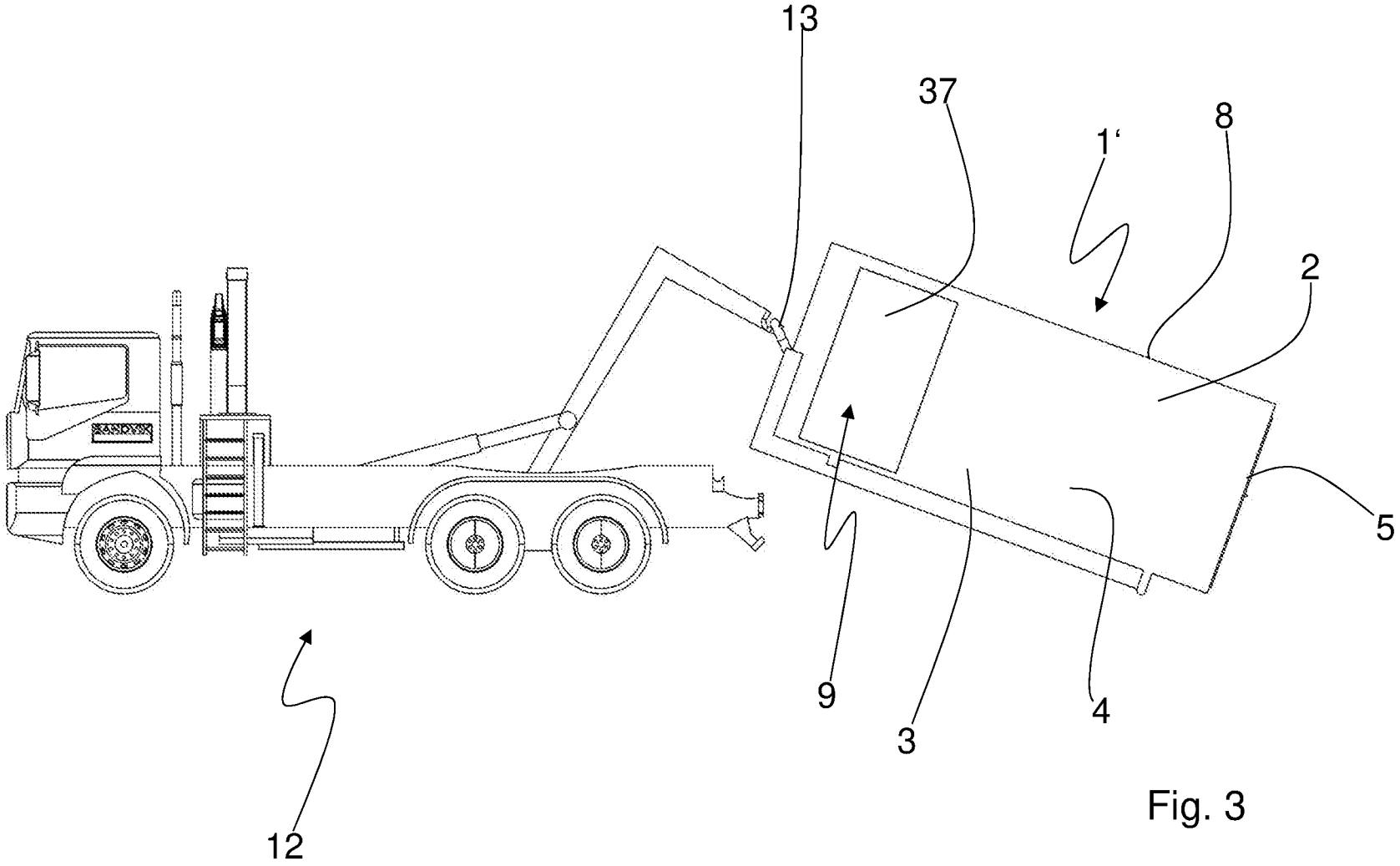
FIG. 3 is a side view of the transport system from FIG. 2 when received on a heavy goods vehicle.

The transport systems 1, 1', 1" in FIGS. 1 to 4 are all based in each case on a 40-foot ISO shipping container 2, as is shown partially transparent in FIGS. 1 to 3.

The container 2 has in each case a transport platform in the form of the floor 3 of the container 2, four side walls 4, 5, 6, 7 and a roof 8. A door 37, which closes a loading opening 9, is provided in one of the long walls 4. In addition, the front wall 5 is designed in the form of a double-leaf door, as is usual for shipping containers. An unloading opening 10, through which sections 11 of the wire can be taken out of the container 2, is additionally provided in the front wall 5. It is understood that the unloading opening 10 can be closed with the aid of a cover plate, in order to completely protect the inside of the container 2 from environmental conditions during transport.

In the embodiment represented, the container is additionally received on a rolling adapter, with the result that the container can be transported and set down with pinpoint accuracy with the aid of a heavy goods vehicle 12 equipped for it, as shown by way of example in FIG. 3. Such a rolling adapter has the same receiving hook 13 as well as rollers (not represented in the figures), as are known from roller containers.

In addition to the container 2, the transport system 1, 1', 1" in each case comprises devices inside the container 2. The basis for the transport or the delivery of a wire 18 is in each case the receptacle 14 or 14' for the coiled wire 18. The variants of FIGS. 1 and 2 differ in the design of the receptacle 14, 14' for the coiled wire.

Figure 4:
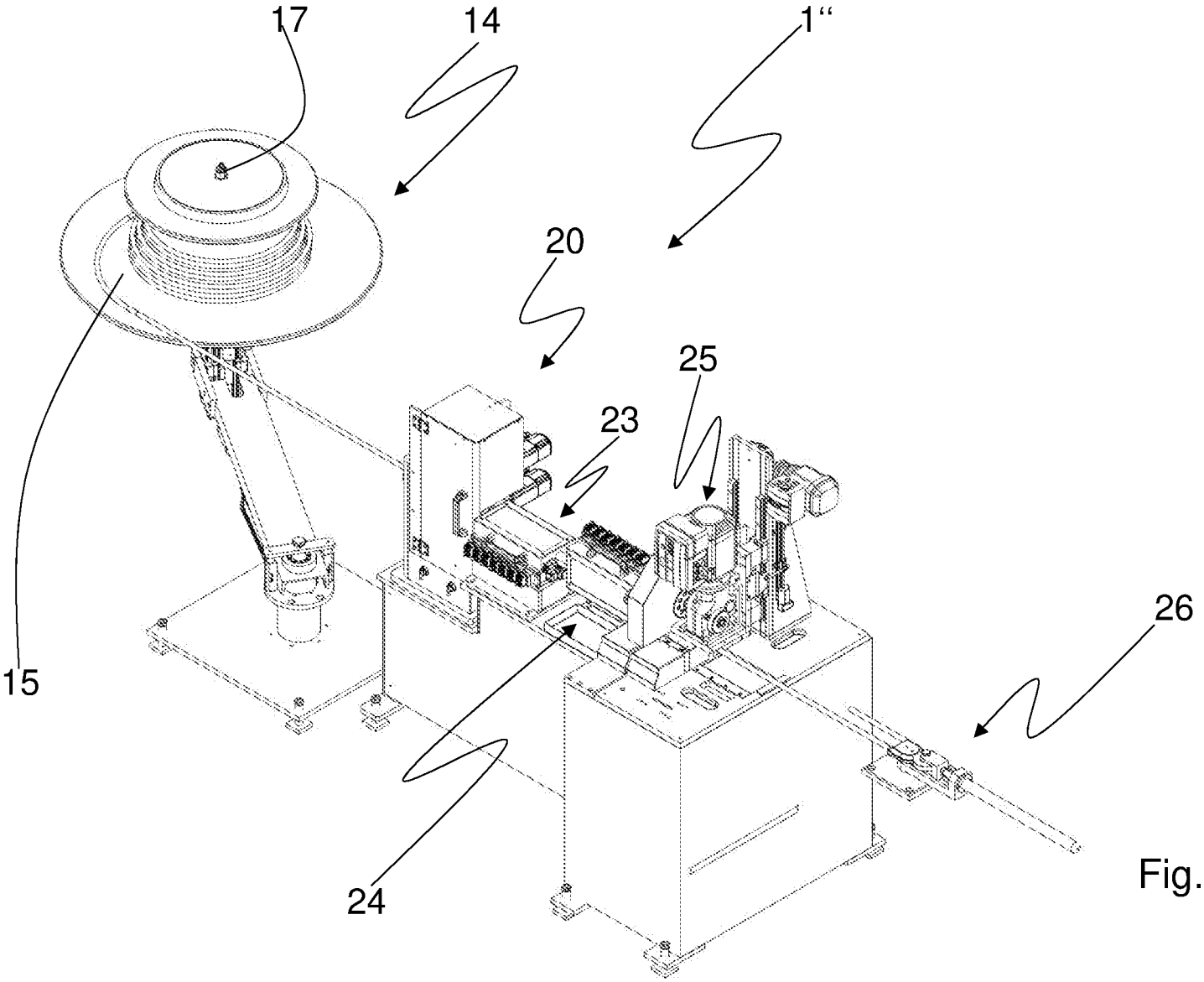
FIG. 4 is a perspective view diagonally from above of the devices inside a transport container, as they are when they are a constituent of a transport system according to a variant of the present disclosure.

In the case of the transport system 1 from FIG. 1 the receptacle 14 is a reel 15 for loading a so-called loose coil. i.e. a coiled wire which was coiled without a core. The reel 15 is a constituent of the receptacle 14 and is typically not changed even when wire material is added again. The receptacle 14 moreover comprises a tilt device 16, which makes it possible to adjust the reel 15 both in terms of height and in terms of the alignment of its axis of rotation 17. The height of the reel 15 is matched to the height of the intake for the wire 18 into the further devices of the transport system 1. To load the loose coil onto the reel 15, its axis of rotation 17 can be tilted such that the axis of rotation 17 is aligned substantially horizontally (not shown in the figures), with the result that it is easy for a user to hang the loose coil on the reel. The reel is then tilted such that its axis of rotation 17 is substantially vertical (as shown in FIGS. 1 and 4).

The receptacle 14' for the coiled wire of the variant from FIG. 2 has a two-part receptacle mounting 27 for a drum 19 with the wire 18 coiled thereon. In the variant with such a drum 19, almost any desired wire lengths can be provided to the customer with the aid of the transport system 1'. The length of the wire is ultimately limited only by the volume of the drum 19.

The variants of the transport system 1, 1' shown are in each case a transport system for a wire made of a stainless steel which was produced by cold-forming. The long wire lengths on the drum 19 are produced by welding several wires at their end faces. The material properties of the work-hardened wires in the vicinity of the welded joint are, however, negatively altered by the welding. These must therefore be cut out of the wire 18 before the wire sections are ejected for the customer, and represent scrap which is to be recycled.

In the two variants of FIGS. 1 and 2 the wire 18 is inserted into a driving tool 20 as the drive within the meaning of the present disclosure. In particular in the case of the long wire lengths, as provided on the drum 19 of FIG. 2, one end of the wire 18 is already inserted into the driving tool 20 when the transport system 1, 1' is delivered to the customer. The finishing of the wire sections 11 can begin immediately. In the variant shown, the driving tool 20 is a roller driving tool with two rollers 21, 22, which are motor-driven and are in frictional engagement with the wire 18, with the result that during operation the wire 18 experiences a propulsion towards the unloading opening 10.

A straightening device in the form of a straightening set 23, 24 with a plurality of profile rollers is provided behind the driving tool 20 in the feed direction. The straightening set has two sets 23, 24 of rollers, wherein the axes of rotation of the rollers of the first set 23 are perpendicular to the axes of rotation of the rollers of the second set 24. The straightening device 24 serves to provide the wire 18, which has been given a curvature of its surfaces by the coiling, with the necessary straightness.

A cutting device in the form of a parting-off head 25, which rotates around the wire 18 in a motor-driven manner and severs it, is provided behind the straightening device 23, 24 in the conveying direction. After the parting-off with the aid of the cutting device 25, the wire section 11 can be taken from the transport system 1, 1' in the desired straightness and length.

FIG. 4 shows a further variant of the devices inside the container 2, wherein the container 2 is not represented in FIG. 4 for the sake of simplicity. Like the variant from FIG. 1, the transport system from FIG. 4 again also has a receptacle for a coiled wire in the form of a loose coil. In addition to the driving tool 20, the straightening set 23, 24 and the parting-off device 25, the variant of the devices of the transport system 1" from FIG. 4 has a bending device 26, which bends the individual wire sections after being parted off with the aid of the cutting device 25 such that the wire sections can then be immediately processed further, i.e. for example installed in industrial machines.

With reference to the variant of the transport system 1' from FIG. 2, the operation of the transport system 1' will now be briefly outlined. In the manufacture by the wire manufacturer, the container 2 is loaded with a wire 18 coiled onto the drum 19. The closed container 2 is then transported to the customer purchasing the wire 18. For the transport, the heavy goods vehicle 12 from FIG. 3 can be used, but the container 2 can also be loaded onto the railway or a ship. At the customer's manufacturing location, which can be a workshop or also a construction site, the container 2 is set down and the final delivery steps can begin immediately. The driving tool 21 draws as much wire 18 off the drum 19 as is required for the wire section 11 to be taken in each case. The customer receives a wire section 11 with a length and quality according to their specification.

Figure 5:
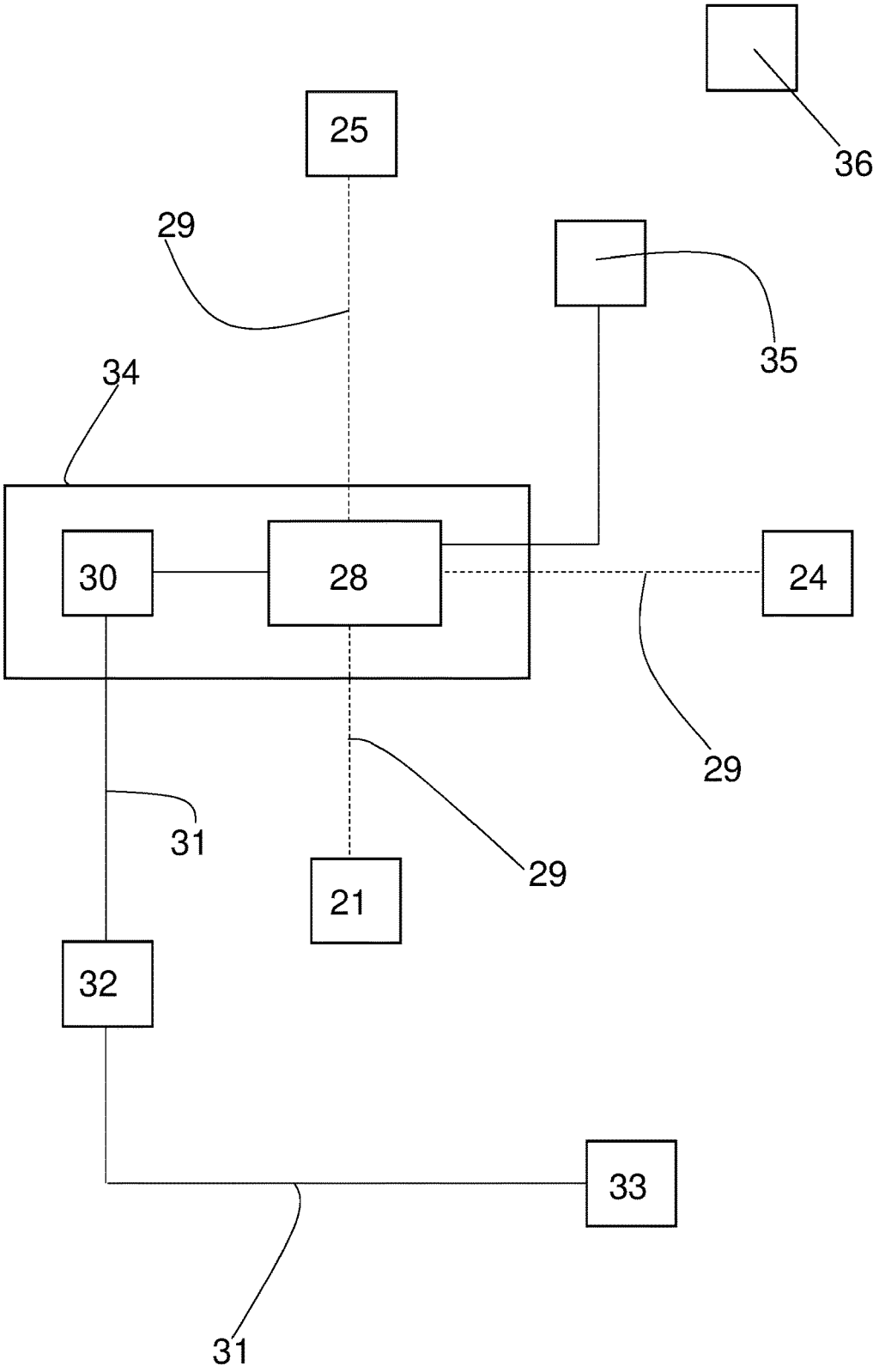
FIG. 5 is a schematic representation of the controller of a transport system according to FIG. 2

FIG. 5 shows, in a schematic diagram, how the transport system 1' bridges the manufacture by the wire manufacturer and the further processing by the customer. For this, the transport system 1' has a controller 34 with a computer 28. This computer 28 (not shown in FIGS. 1 to 3) is connected to the individual devices of the container 2, namely the receptacle 14', the driving tool 21, and the parting-off head 25, via corresponding data lines 29. The computer 28 now assumes the control of all further delivery steps, until the wire section 11 can be taken out of the container 2 through the unloading opening 10 after the parting-off.

However, the computer 28 additionally also receives information about the operational state of the individual devices 21, 24, 25 via the data lines 29. From this information on the operational state, the computer 28 can deduce how many metres of the wire 18 have already been drawn off the drum 19 and taken from the container 2 in cut form. As the controller, in addition to the computer 28, also has a mobile radio interface 30 connected to the computer 28, the computer 28 is capable of communicating with a server 32 of the wire manufacturer over the Internet 31. The server 32 in turn is connected to a computer 33 of the customer over the internee. In this way, the wire manufacturer's server 32 can generate invoices for the lengths of the wire 18 taken from the container 2 in an automated manner. In addition, certificates for the individual wire sections 11 can be transmitted to the customer in an automated manner. If the computer 28 establishes that the entire length of the wire 18 received on the drum 19 will be drawn off within a particular time, the computer 28 triggers a repeat order for a wire 18 of the same type via the communications interface 30, the Internet 31 and the wire manufacturer's server 32. This is then delivered to the customer in a new container 2 in time. The delivering HGV 12 can then replace the empty container with the full container at the customer's location.

Furthermore, the computer 28 of the controller 34 is connected to an electronic reading device in the form of a contactless RFID reader 35. The RFID reader 35 serves to read RFID tags 36 which are arranged on the drum 19. In this way, the transport system 1' can detect, in an automated manner, the type of wire 18 which is provided on the drum 19. The corresponding information is stored in the RFID tag 36.

For the purposes of original disclosure, it is pointed out that all features, as revealed to a person skilled in the art from the present description, the drawings and the claims, even if they were described specifically only in connection with particular further features, can be combined with others of the features or groups of features disclosed here both individually and in any desired combinations, unless this has been expressly ruled out or technical circumstances make such combinations impossible or pointless. The comprehensive, explicit representation of all conceivable combinations of features is dispensed with here only for the sake of the brevity and readability of the description.

While the disclosure has been represented and described in detail in the drawings and the preceding description, this representation and description is effected merely by way of example and is not intended as a limitation of the scope of protection as defined by the claims. The disclosure is not limited to the embodiments shown.

Modifications of the disclosed embodiments are obvious for a person skilled in the art from the drawings, the description and the attached claims. In the claims the word "have" does not exclude other elements or steps, and the indefinite article "a" or "an" does not exclude a plurality. The mere fact of particular features being claimed in different claims does not exclude the combination thereof. Reference numbers in the claims are not intended as a limitation of the scope of protection.

LIST OF REFERENCE NUMBERS

1, 1' 1" transport system
2 container
3 floor of the container 2
4, 5, 6, 7 side wall of the container 2
8 roof
9 loading opening
10 unloading opening
11 wire section
12 heavy goods vehicle
13 receiving hook
14, 14' receptacle for a coiled wire
15 reel
16 tilt device
17 axis of rotation
18 wire
19 drum
20 driving tool
21, 22 rollers of the driving tool 20
23 first part of the straightening set
24 second part of the straightening set
25 cutting device
26 bending device
27 receptacle mounting
28 computer
29 data line
30 mobile radio interface
31 Internet
32 wire manufacturer's server
33 customer's computer
34 controller
35 RFID reader
36 RFID tag
37 door

The invention claimed is:

1. Transport system for a wire or a sheet, comprising:
a transport platform;
a receptacle for the wire or the sheet, wherein the receptacle is configured such that the wire or the sheet can be received coiled up on the receptacle;
a drive, wherein the drive is configured such that, with the drive, the wire or the sheet can be conveyed in a transport direction;
a straightening device, wherein the straightening device is configured such that the wire or the sheet can be straightened with the straightening device; and
a transport container including a floor, four side walls and a roof, where the transport platform is the floor of the transport container or the transport platform is received on the floor of the transport container,
wherein the receptacle, the drive and the straightening device are arranged on the transport platform such that, with the drive, the wire or the sheet can be drawn off the receptacle and fed to the straightening device in an automated manner,
wherein a closable unloading opening is provided in one of the side walls or in the roof, with the result that a section of the wire or the sheet can be taken out of the transport system through the unloading opening, and
wherein the receptacle, the drive, and the straightening device are arranged such that a section of the wire or the sheet can be ejected through the unloading opening.

2. Transport system according to claim 1, wherein the transport platform is sized for transport using a means for transport or a crane.

3. Transport system according to claim 1, further comprising a cutting device,
wherein the cutting device is configured and arranged such that the wire or the sheet can be severed with the cutting device, with the result that a section can be produced with a selectable length, and
wherein the cutting device is arranged on the transport platform such that, with the drive, the wire or the sheet drawn off the receptacle and fed to the straightening device is further fed to the cutting device in an automated manner.

4. Transport system according to claim 3, wherein the transport system has an electronic controller effectively connected at least to the receptacle, the drive or the cutting device, and wherein the electronic controller is configured such that, during operation of the transport system, the electronic controller receives data from at least the receptacle, the drive or the cutting device and/or issues control commands to at least the receptacle, the drive or the cutting device.

5. Transport system according to claim 4, wherein the electronic controller comprises a communications interface, and wherein the communications interface is configured such that, with the communications interface, data can be transmitted from the transport system to a server over a data network.

6. Transport system according to claim 4, wherein the electronic controller has an electronic reading device for contactlessly reading a data carrier.

7. Transport system according to claim 6, wherein the receptacle is a drum or a reel, and wherein the receptacle is provided with a contactlessly readable data carrier, which can be read by the reading device.

8. Transport system according to claim 6, wherein the transport system has a coiled wire or a coiled sheet, wherein the wire or the sheet is received on the receptacle and wherein the wire or the sheet is provided with a contactlessly readable data carrier, which can be read by the reading device.

9. Transport system according to claim 1, wherein the transport system has a coiled wire or a coiled sheet, wherein the wire or the sheet is received on the receptacle, and wherein the wire or the sheet consists of a plurality of cold-formed sections of the wire or the sheet made of a stainless steel joined together at their end faces.

10. Transport system according to claim 1, wherein the transport system has a marking device arranged on the transport platform for marking a section of the wire or the sheet.

11. Transport system according to claim 1, wherein the transport system has a bending device arranged on the transport platform for defined bending of a section of the wire or the sheet.

12. Transport system according to claim 1, wherein the transport system has a degreasing device arranged on the transport platform for degreasing the wire or the sheet.

13. Transport system according to claim 1, wherein the transport container is a 40-foot ISO shipping container.

14. Method for delivering a wire or sheet, the method comprising the steps of:

coiling up the wire or the sheet;

receiving the wire or the sheet on a receptacle arranged on a transport platform;

transporting the transport platform from a first location to a second location;

conveying the wire or the sheet in a transport direction with a drive arranged on the transport platform, with the result that the wire or the sheet is drawn off the receptacle and fed to a straightening device in an automated manner; and straightening the wire or sheet with the straightening device arranged on the transport platform, wherein the receptacle, the drive and the straightening device are arranged on the transport platform such that, with the drive, the wire or the sheet can be drawn off the receptacle and fed to the straightening device in an automated manner, wherein the transport platform is a floor of a transport container or the transport platform is received on the floor of the transport container, where the transport container further includes four side walls and a roof, wherein a closable unloading opening is provided in one of the side walls or in the roof, with the result that a section of the wire or the sheet can be taken out of the transport system through the unloading opening, and wherein the receptacle, the drive, and the straightening device are arranged such that a section of the wire or the sheet can be ejected through the unloading opening.

15. Method according to claim 14, wherein, through the conveying of the wire or the sheet, the wire or the sheet is fed to a cutting device arranged on the transport platform, and wherein the method furthermore has the step of severing the wire or the sheet with the cutting device, with the result that a section of the wire or the sheet is produced with a selected length.

16. Method according to claim 15, wherein the conveying, the straightening and the severing are controlled by a common controller, and wherein the method further comprises:

collecting data with the controller, wherein the collected data includes a measure of the length of the wire or the sheet drawn off the receptacle, and transmitting data from the controller to a server via a communications interface and a data network.

17. Transport system according to claim 1, wherein the transport system has an electronic controller effectively connected at least to the receptacle or the drive, and wherein the electronic controller is configured such that, during operation of the transport system, the electronic controller receives data from at least the receptacle or the drive and/or issues control commands to at least the receptacle or the drive.

18. Transport system according to claim 17, wherein the electronic controller comprises a communications interface, and wherein the communications interface is configured such that, with the communications interface, data can be transmitted from the transport system to a server over a data network.

19. Transport system according to claim 17, wherein the electronic controller has an electronic reading device for contactlessly reading a data carrier.

20. Transport system according to claim 19, wherein the transport system has a drum for the coiled wire or the coiled sheet, wherein the drum is received on the receptacle, and wherein the drum is provided with a contactlessly readable data carrier, which can be read by the reading device.

21. Transport system according to claim 19, wherein the transport system has a coiled wire or a coiled sheet, wherein the wire or the sheet is received on the receptacle and wherein the wire or the sheet is provided with a contactlessly readable data carrier, which can be read by the reading device.

* * * * *